US005123648A

United States Patent [19]

Schmidt

[11] Patent Number: 5,123,648

[45] Date of Patent: Jun. 23, 1992

[54] DEVICE FOR SELECTING A NUMBER, LETTER OR OTHER SYMBOL

[76] Inventor: Frank A. Schmidt, 5142 Encino Ave., Encino, Calif. 91316

[21] Appl. No.: 741,101

[22] Filed: Aug. 6, 1991

[51] Int. Cl.[5] ..... A63F 3/06

[52] U.S. Cl. ..... 273/142 JD; 273/142 J

[58] Field of Search ..... 273/142 JA, 142 JB, 273/142 JC, 142 JD, 142 J, 142 R, 142 A, 142 B, 142 C, 142 H, 142 HA

[56] References Cited

U.S. PATENT DOCUMENTS 818,153 4/1906 Ehebald ..... 273/142 J
1,479,774 1/1924 Steinmetz ..... 273/142 JD

FOREIGN PATENT DOCUMENTS 413981 7/1934 United Kingdom ..... 273/142 J

*Primary Examiner*—Benjamin Layno
*Attorney, Agent, or Firm*—William P. Green

[57] ABSTRACT

A device for selecting a particular number, letter or other symbol for a lottery game or the like, and which includes a body adapted to be held by a user and carrying a wheel which is manually rotatable relative to the body and which has a series of numbers or other markings movable to a predetermined viewing position in different settings of the wheel. A member is mounted to the body for movement between a position blocking viewing of the markings during rotation of the wheel and permitting viewing of a single marking when the wheel is stopped. Preferably, the member acts to lock the wheel in a particular setting when in viewing condition, and is yieldingly urged by a spring to the position in which the wheel is free to turn.

13 Claims, 2 Drawing Sheets

DEVICE FOR SELECTING A NUMBER, LETTER OR OTHER SYMBOL

This invention relates to devices for assisting a person in choosing numbers for a lottery, or in selecting numbers, letters, or other symbols or markings for any other similar purpose.

BACKGROUND OF THE INVENTION

Many different systems and procedures have been devised for choosing numbers to be bet on in a lottery, or for selecting numbers, letters, playing cards, or other symbols or markings for other types of games or contests. Frequently, a player selects numbers based on birthday dates, addresses, license numbers or other numbers having particular significance to him, or he may use a physical object or device to arrive at a choice. Numbers chosen for an identifiable reason or chosen by a device are felt to be preferable to numbers chosen otherwise, and tend to induce a feeling that the chances of success have been increased.

SUMMARY OF THE INVENTION

The present invention provides a device which mechanically chooses a particular number or other marking out of a series of such markings in a manner which is completely uncontrollable and unpredictable, but which creates and maintains interest by requiring the user to manually actuate the device for each selection. The device includes a body which can be held in the hand of a user and which carries a wheel adapted to be manually spun relative to the body to different settings not predetermineable by the user. During the spinning operation, the user can not see the different numbers or other markings, but when the wheel is stopped he can actuate a viewing member relative to the body and wheel to a position exposing the selected marking. This procedure is repeated until six numbers have been chosen, or until any other desired number of markings have been selected.

The viewing member preferably serves a dual function of exposing one of the markings to view and at the same time locking the wheel against rotation from that particular setting. The viewing member may be spring urged to one of its two positions and be manually actuable to the other position. Desirably, the spring yieldingly urges the member to a position in which the wheel is free for rotation and the numbers are out of view, and is manually actuable to a position locking the wheel against rotation and exposing the particular selected number to view. The wheel may have peripheral teeth projecting beyond the body and adapted to be engaged by a user's hand to spin the wheel, with those same teeth being engageable by the viewing member to lock the wheel against rotation.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENT

Figure 1:
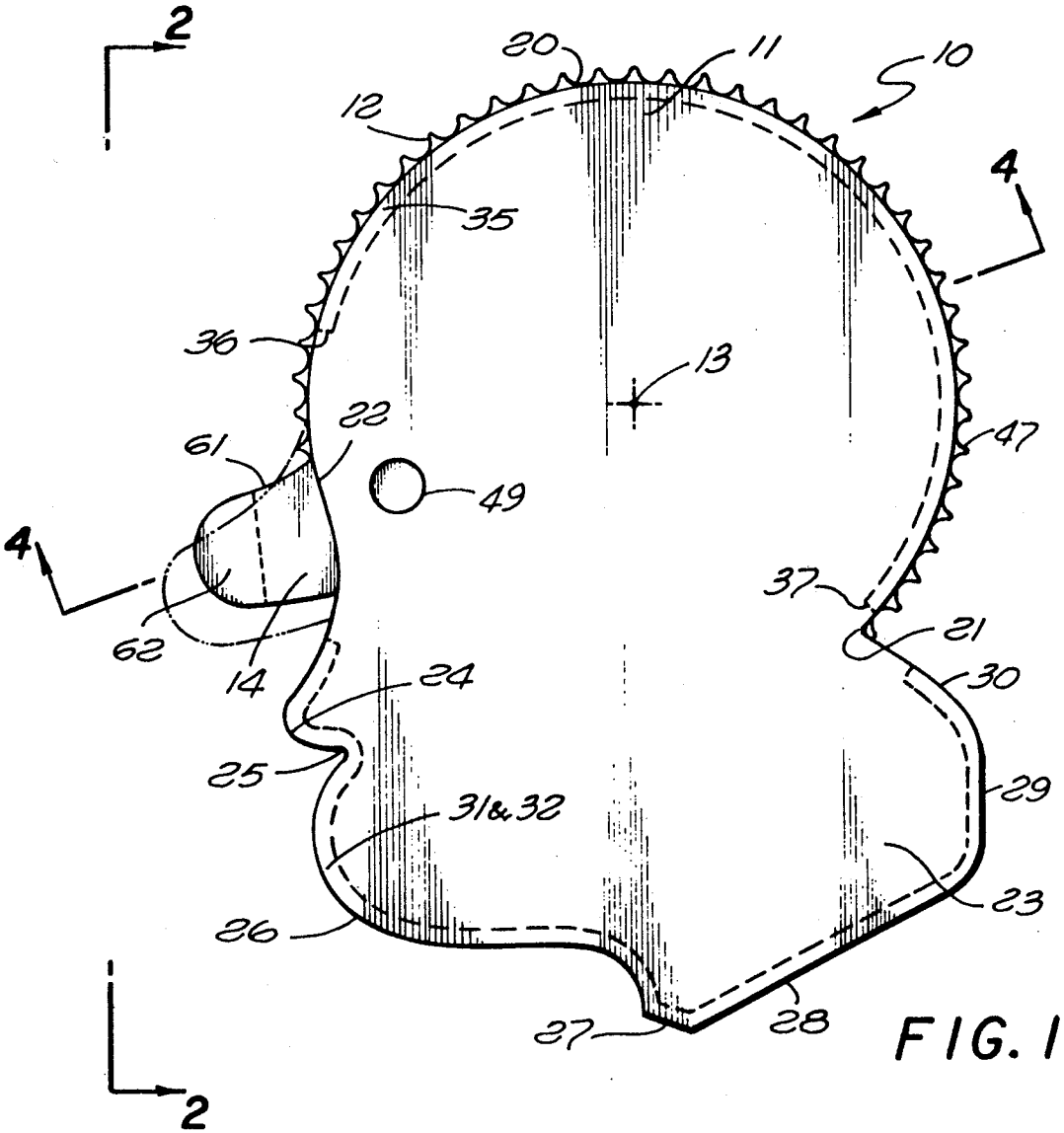
FIG. 1 is a front elevational view of a device embodying the invention.
Figure 2:
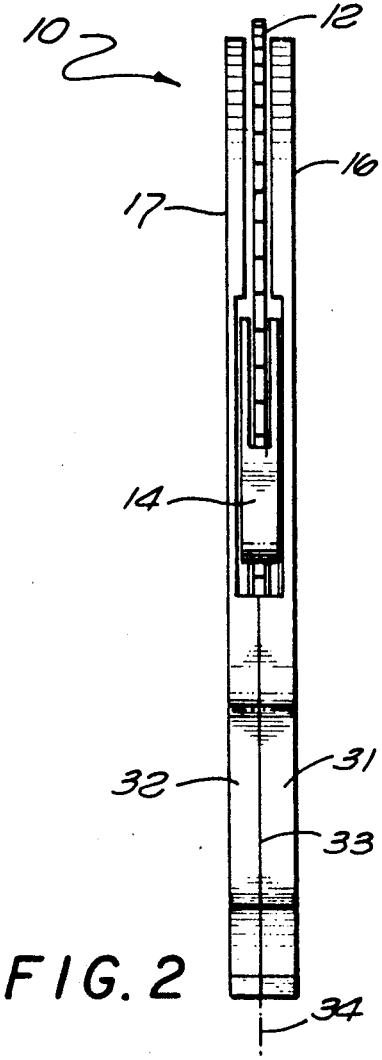
FIG. 2 is an elevational view taken on line 2—2 of FIG. 1.
Figure 3:
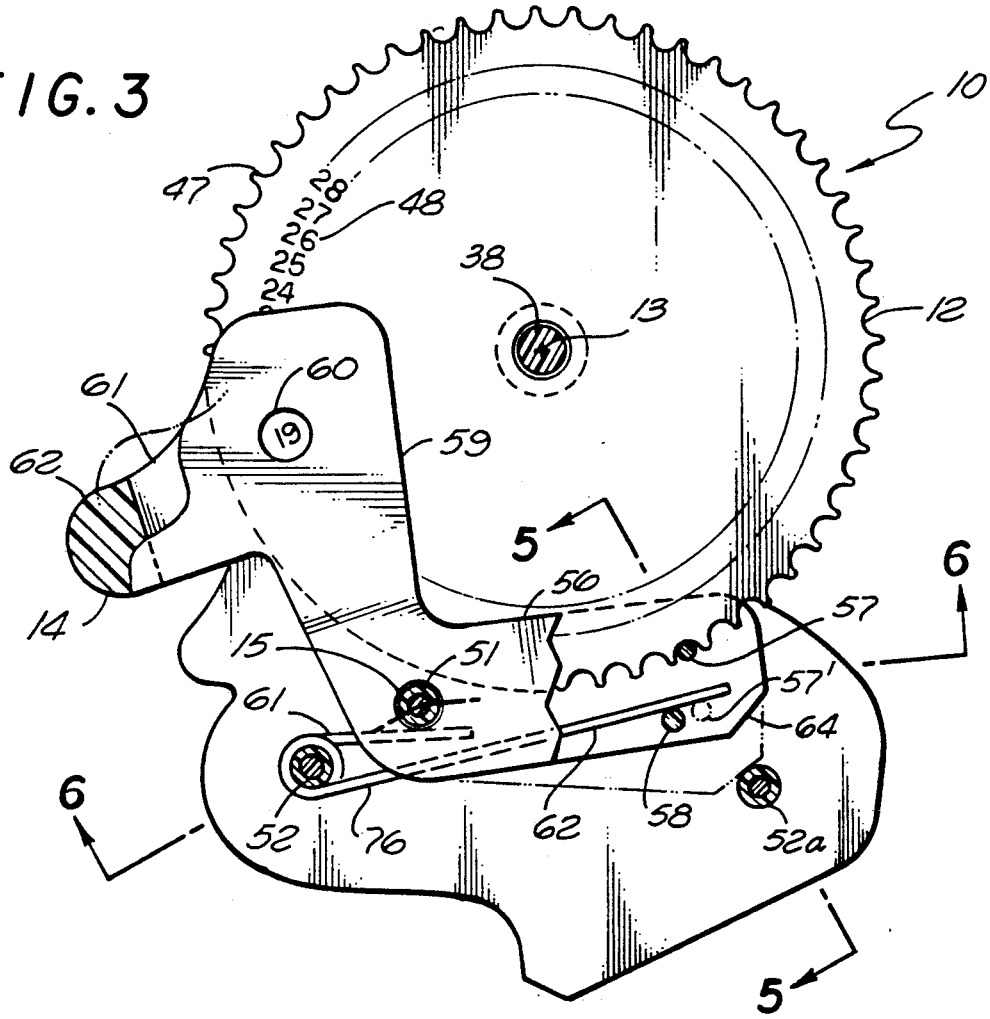
FIG. 3 illustrates a portion of the device in a view similar to FIG. 1, but with the front wall of the body of the device broken away to reveal the internal mechanism.

Referring first to FIGS. 1 and 3, the device 10 illustrated in the drawings includes a body 11 adapted to be held in the hand of a user, a wheel or disc 12 connected to the body for relative rotation about an axis 13, a member 14 connected to the body for relative pivotal movement about an axis 15, and a spring 76 urging member 14 to the position represented in full lines in FIG. 1. Parts 11, 12 and 14 may be formed of an appropriate rigid plastic material.

Body 11 is hollow to contain the other parts, and is preferably formed of front and rear sections 16 and 17 cemented together at various contacting surfaces. Forward section 16 forms a planar front wall 18 extending perpendicular to axes 13 and 15, and rear section 17 forms a similar planar rear wall 19 also disposed perpendicular to the two axes and parallel to but spaced from front wall 18. These two walls are shaped similarly, having the perpipheral outline configuration illustrated in FIG. 1. More particularly, the upper portion of each of the front and rear walls 18 and 19 has a peripheral edge 20 extending arcuately about axis 13 through almost 270 degrees, between the locations 21 and 22 of FIG. 1. The lower portion 23 of each of the front and rear walls 18 and 19 projects downwardly farther from axis 13 than does the arcuately or circularly extending peripheral edge 20 of the upper portion of each of the walls, and may be shaped as illustrated in FIG. 1 to provide a handle portion of the body by which a user holds the body in one of his hands.

To define the typically illustrated outline configuration of the downwardly enlarged lower portions 23 of front and rear walls 18 and 19, the peripheral edges of these portions 23, commencing at the location 22 of FIG. 1, extend first downwardly and slightly rightwardly, then slightly leftwardly to a region 24, then forming an indentation 25, a curving section 26, a projection 27, and three generally straight edges 28, 29 and 30 leading to the point 21. Along the periphery of the lower portions 23 of front and rear walls 18 and 19, those walls carry flanges 31 and 32 molded integrally with the front and rear walls and having edges 33 meeting in a central plane 34 perpendicular to axis 13. The edges 33 of the two sections may be cemented or otherwise adhered together to secure the two body sections rigidly to one another. The arcuately extending peripheral edges 20 of the upper portions of the two body sections have flanges 35, extending between the locations 36 and 37 of FIG. 1 and projecting toward one another but spaced apart far enough for reception of wheel 12 therebetween.

At the location of axis 13, one of the body sections has an integrally formed pin portion 38 which projects into a recess 39 in the other body part and is cemented thereto within that recess, to further secure the two body sections together and form a shaft mounting wheel 12 for free rotation about axis 13. Shaft 38 has an external cylindrical surface 40 centered about axis 13, with wheel 12 having a central opening 41 with a cylindrical internal surface disposed about and fitting closely but rotatably on the shaft. Walls 18 and 19 of the body may have circular portions 42 thickened inwardly toward one another with inner parallel planar surfaces 43 perpendicular to axis 13 and spaced apart a distance slightly greater than the thickness dimension t of wheel 12, to maintain the wheel out of contact with the inner planar surfaces 44 of walls 18 and 19, and out of contact with flanges 35, during rotation of the wheel.

Wheel 12 may be a flat disc having parallel front and rear surfaces 45 and 46 perpendicular to axis 13. At its periphery, wheel 12 has a series of evenly circularly spaced identical teeth 47 which are centered about axis 13 and project radially outwardly a short distance beyond the diameter of arcuate edges 20 of the upper portions of the front and rear sections of the body, so the teeth can be touched by a user's fingers or thumb to manually spin the wheel relative to the body. On its front side, as seen in FIG. 3, wheel 12 has a circular series of markings 48 which are individually visible through a typically circular opening 49 formed in front wall 18 at the location illustrated in FIG. 1. The markings 48 may be numbers, letters, pictures, playing card designations (king, queen, etc.) or any other type of symbol to be utilized in a particular game, contest, or for other reasons. In the particular arrangement illustrated in the drawings, the markings 48 consist of a circular series of numbers running from 1 through 48, with these numbers being visible individually through opening 49 in 48 different rotary positions of wheel 12 relative to the body.

The numbers 1 through 48 (or other markings) are duplicated on the rear surface 46 of wheel 12, with each of the numbers on the rear surface being directly axially opposite the corresponding number on the forward surface 45 of the wheel. Also, rear wall 19 has a circular opening **49*a* directly opposite the opening 49 in front wall 18, so that in any particular setting of wheel 12, the same number is visible through each of the front and rear openings 49 and 49*a***.

Figure 6:
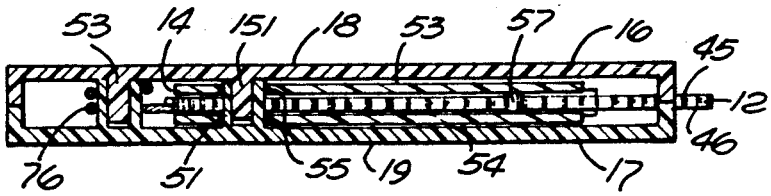

As seen in FIGS. 3 & 6, the member 14 is mounted for pivotal movement by an externally cylindrical pin 51 centered about an axis parallel to axis 13 and formed integrally with one of the front and rear walls 18 or 19 of the body and projecting toward the other of these walls. That other wall preferably has a smaller second pin 151 projecting into pin 51 and cemented thereto to secure the parts together. Similar pairs of interfitting pins projecting from the two body sections and cemented together may be provided at the two locations identified by the numbers 52 and **52*a* in FIG. 3**.

Figure 4:
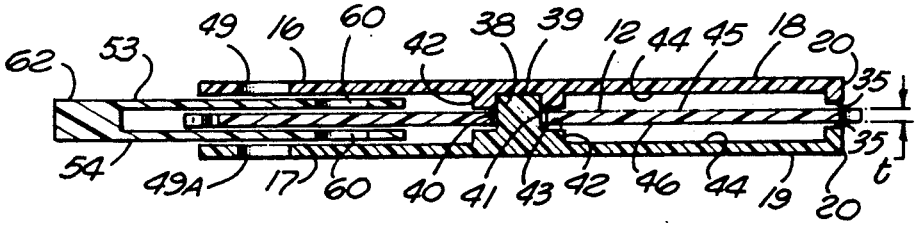
FIG. 4 is a section taken on line 4—4 of FIG. 1.
Figure 5:
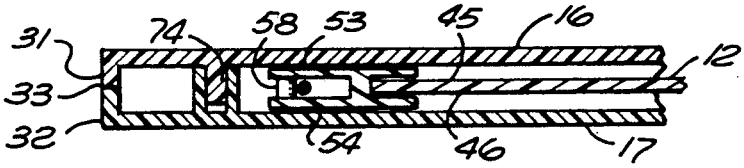
FIGS. 5 and 6 are sections taken on lines 5—5 and 6—6 respectively of FIG. 3.

Member 14 may be molded integrally as a single piece of rigid resinous plastic material having the generally bell crank shape illustrated in FIG. 3. This member forms two parallel planar front and rear walls 53 and 54 disposed perpendicular to axis 13 and parallel to front and rear walls 18 and 19 and wheel 12. As seen in FIGS. 4, 5 and 6, forward wall 53 of member 14 is received between and spaced slightly from front wall 18 of the body and wheel 12, while rear wall 54 of member 14 is received at the opposite side of wheel 12 and is between and spaced slightly from that wheel and rear wall 19 of the body. Aligned circular openings 55 in these walls 53 and 54 of member 14 fit closely about pin 51, to mount member 14 for pivotal movement between the full line and broken line positions of FIGS. 1 and 3. Walls 53 and 54 of member 14 form first arms 56 which project rightwardly from the location of openings 55 and carry two integrally formed pins 57 and 58 extending between walls 53 and 54 and parallel to axis 13. In the broken line position of FIG. 1 (full line position of FIG. 3), pin 57 is received between two successive teeth 47 of wheel 12, to lock the wheel in a particular set position in which one of the numbers 48 is visible through and centered within opening 49, and a corresponding number is visible through opening **49*a* at the opposite side of the device. Pin 57 is cylindrical and dimensioned to fit closely between any two successive teeth 47, to prevent any substantial rotary movement of the wheel from a position in which one of the numbers is properly centered within each of the openings 49 and 49*a*. The tapered configuration of the teeth and the cylindrical configuration of pin 57 act to cam the wheel to a position properly centering the numbers ally from its full line position of FIG. 1 to its full line position of FIG. 3. In the broken line position of FIG. 1 (full line position of FIG. 3) pin 57 is swung out of engagement with teeth 47, as represented at 57' in FIG. 3** to allow free rotation of the wheel.

Projecting upwardly from the location of pivot pin 51, the two front and rear wall portions 53 and 54 of member 14 have similar arms 59 containing axially aligned circular openings 60, with actuating portions 61 of walls 53 and 54 projecting leftwardly in FIGS. 1 and 3 beyond the periphery of wheel 12 and beyond the peripheral edges of the front and rear sections of the body to form a handle by which a user can manually pivot member 14 from the full line position of FIG. 1 to the broken line position of that figure. At the extremity of this handle portion of member 14, the front and rear walls 53 and 54 of that member may be integrally molded together at 62.

The openings 60 in the front and rear portions of member 14 are circular and of a diameter corresponding to openings 49 and **49*a* of the front and rear sections of body 11, and are positioned to be directly opposite and register with those openings 49 and 49*a* respectively in the FIG. 3 full line position of member 14. Thus, in that position, the particular number 48 which is opposite each of the openings 49 and 49*a* is visible from the exterior of the body through those openings and through openings 60 of member 14. The pivotal movement of member 14 is limited in that position by the previously mentioned engagement of pin 57 with teeth 47 of wheel 12**.

When member 14 is in the full line position of FIG. 1, the openings 60 of member 14 are not aligned with openings 49 and **49*a* of the body, and are entirely offset from those openings, so that walls 53 and 54 of member 14 extend across openings 49 and 49*a* and prevent a user from viewing any number through those openings. Member 14 is normally retained in that full line position of FIG. 1 by spring 76 (FIG. 3), which is formed of spring wire shaped to the configuration illustrated in that figure. The spring is coiled about pin 52 at 76 and forms a first arm 61 bearing upwardly against pin 51 and a second arm 62 bearing downwardly against pin 58 of member 14. The clockwise pivotal movement of member 14 by spring 76 to the full line position of FIG. 1 is limited by engagement of edge surfaces 64 of walls 53 and 54 of member 14 with pin 52*a*** of the body.

In using the device, a person grasps the lower portion of body 11 in one hand, and engages teeth 47 of wheel 12 with the other hand to spin the wheel relative to the body. During this spinning motion, none of the numbers are visible through openings 49 and **49*a* at the front and rear of the body, since member 14 is retained by spring 76 in the full line position of FIG. 1**, in which member 14 blocks viewing through openings 49 and 49*a*, and in which pin 57 carried by member 14 is out of contact with teeth 47 and thus permits free spinning movement of the wheel. When the wheel stops, the user presses downwardly on the outwardly projecting handle portion 61-62 of member 14 to pivot that member to its full line position of FIG. 3, in which openings 60 of member 14 are aligned with openings 49 and 49*a* and permit the user to view corresponding individual numbers at opposite sides of the device. At the same time, pin 57 carried by member 14 moves into engagement with two of the teeth of wheel 12 to lock the wheel in a position in which the selected number is properly centered within the viewing openings. After that number has been noted, member 14 can be released to permit the wheel to be spun again for selection of the next successive number. The proccess can be repeated to make any desired number of selections. If the user prefers not to wait until the wheel has stopped of its own accord on each spin, he may actuate member 14 to its broken line position in FIG. 1 while the wheel is spinning, and in this way stop the wheel forcibly by engagement of pin 57 with the teeth.

While a certain specific embodiment of the present invention has been disclosed as typical, the invention is of course not limited to that particular form, but rather is applicable broadly to all such variations as fall within the scope of the appended claims.

I claim:

1. A device comprising:

a body adapted to be held by a user;

a wheel contained within the interior of said body and mounted for rotation about a predetermined axis relative to the body and having a peripheral portion projecting beyond the body and adapted to be engaged by a user's hand to manually rotate the wheel relative to the body;

said wheel carrying a series of markings centered about said axis;

said body having a wall covering most of said markings and containing an opening through which different ones of said markings are visible from the exterior of the body in different rotary settings of the wheel;

a member connected pivotally to said body for relative movement between a first position in which a portion of said member is disposed across said opening in said wall of the body and blocks viewing of a marking through the opening as the wheel turns, and a second position permitting a user to see one of said markings through the opening after the wheel stops;

said member having a portion which is engageable with said wheel in said second position of the member to lock the wheel against rotation relative to the body, and which is retractable in said first position of the member to permit rotation of the wheel; and a spring within the body yieldingly urging said member to said first position relative to the body.

2. A device as recited in claim 1, in which said peripheral portion of said wheel forms a series of circularly spaced teeth engageable by a user to spin the wheel, and which are contacted by said member in said second position thereof to lock the wheel against rotation.

3. A device as recited in claim 1, in which said wheel has two of said series of markings at opposite sides of the wheel, and said member has two arms received at opposite sides of the wheel and each coacting with one of said series of markings to block viewing of the markings in said first position of the member and permit viewing of a marking after the wheel stops.

4. A device comprising:

a body adapted to be held by a user and having two essentially parallel front and rear walls with similar peripheral edges extending essentially circularly about a predetermined axis perpendicular to said walls;

a wheel between said walls mounted for rotation relative thereto about said axis and having a series of circularly spaced teeth projecting outwardly beyond said peripheral edges of said walls and adapted to be engaged by a user's hand to manually spin the wheel;

said wheel having two circular series of markings at opposite sides respectively of the wheel and centered about said axis, with said front and rear walls of the body preventing viewing of most of said markings;

a member received between said front and rear walls of the body and connected to said walls for pivotal movement relative to the body and relative to said wheel about a second axis extending essentially parallel to said first axis and located beyond the periphery of said wheel;

said member having a portion projecting outwardly beyond the body and wheel and adapted to be engaged by a user to manually pivot said member between a first position and a second position;

said front and rear walls of the body containing openings through which corresponding individual ones of said markings of the two series of markings can be viewed;

said member having two arms received between said front and rear walls of the body and received at opposite sides respectively of said wheel, and which are disposed across said openings of the front and rear walls respectively to block viewing of the markings through both of said openings of the front and rear walls when the member is in said first position thereof;

said two arms of said member containing openings which register with said openings of the front and rear walls of the body in said second position of the member to permit viewing of individual ones of said two series of markings in said second position of the member;

a spring received between said front and rear walls of said body and yieldingly urging said member to said first position thereof;

said member having a locking portion which is engageable with said teeth of said wheel in said second position of the member to lock the wheel against rotation, and which is movable away from engagement with said teeth in said first position of the member to permit manual spinning of the wheel to a changed setting.

5. A device comprising:

a body;

a wheel which carries a series of markings and which is mounted to said body for rotation relative thereto between different rotary settings in which different ones of said markings are at a predetermined viewing location relative to the body; and a member mounted for movement relative to said body between a first position in which it blocks viewing of said markings at said viewing location as the wheel turns and a second position permitting a user to see one of said markings at said location after the wheel stops;

said member being operable to lock said wheel against rotation when said member is in said second position thereof.

6. A device comprising:

a body;

a wheel which carries a series of markings and which is mounted to said body for rotation relative thereto between different rotary settings in which different ones of said markings are at a predetermined viewing location relative to the body; and a member mounted for movement relative to said body between a first position in which it blocks viewing of said markings at said viewing location as the wheel turns and a second position permitting a user to see one of said markings at said location after the wheel stops;

said member being mounted for pivotal movement relative to said body between said first and second positions.

7. A device comprising:

a body;

a wheel which carries a series of markings and which is mounted to said body for rotation relative thereto between different rotary settings in which different ones of said markings are at a predetermined viewing location relative to the body; and a member mounted for movement relative to said body between a first position in which it blocks viewing of said markings at said viewing location as the wheel turns and a second position permitting a user to see one of said markings at said location after the wheel stops;

said body containing a window through which one of said markings is visible at said predetermined viewing location, and said member having a portion which is disposed across said window when the member is in said first position thereof;

said member containing an opening which is movable into registry with said window in said second position of the member to permit viewing of a marking at said viewing location through the window and opening.

8. A device comprising:

a body;

a wheel which carries a series of markings and which is mounted to said body for rotation relative thereto between different rotary settings in which different ones of said markings are at a predetermined viewing location relative to the body; and a member mounted for movement relative to said body between a first position in which it blocks viewing of said markings at said viewing location as the wheel turns and a second position permitting a user to see one of said markings at said location after the wheel stops;

said wheel having a series of teeth, and said member having a portion engageable with said teeth in said second position of the member to lock the wheel against rotation.

9. A device comprising:

a body;

a wheel which carries a series of markings and which is mounted to said body for rotation relative thereto between different rotary settings in which different ones of said markings are at a predetermined viewing location relative to the body; and a member mounted for movement relative to said body between a first position in which it blocks viewing of said markings at said viewing location as the wheel turns and a second position permitting a user to see one of said markings at said location after the wheel stops; and a spring yieldingly urging said member to one of said first and second positions thereof.

10. A device comprising:

a body;

a wheel which carries a series of markings and which is mounted to said body for rotation relative thereto between different rotary settings in which different ones of said markings are at a predetermined viewing location relative to the body;

a member mounted for movement relative to said body between a first position in which it blocks viewing of said markings at said viewing location as the wheel turns and a second position permitting a user to see one of said markings at said location after the wheel stops; and a spring yieldingly urging said member to said first position thereof.

11. A device comprising:

a body;

a wheel which carries two series of markings at its opposite sides and which is mounted to said body for rotation relative thereto between different rotary settings in which different ones of said markings of the two series of markings are at predetermined viewing locations relative to the body; and a member having portions at opposite sides of the wheel and which is mounted for movement relative to said body between a first position in which said portions block viewing of both of said series of markings at said viewing locations as the wheel turns and a second position permitting a user to see corresponding ones of said markings at said viewing locations at both sides of the wheel after the wheel stops.

12. A device as recited in claim 11, in which said member is mounted for pivotal movement relative to said body between said first and second positions.

13. A device comprising:

a body;

a wheel which carries a series of markings and which is mounted to said body for rotation relative thereto between different rotary settings in which different ones of said markings are at a predetermined location relative to the body, with stopping of a particular marking at said location indicating selection of that marking by the device;

means for blocking most of said markings from view while the wheel turns;

said means being operable between a first condition blocking viewing of said markings at said location as the wheel turns and a second condition permitting a user to see one of said markings at said location after the wheel stops; and means responsive to actuation of said first mentioned means from said first condition to said second condition to lock the wheel against rotation when a marking at said location is visible.

* * * * *